US006254421B1

(12) United States Patent
Denovich et al.

(10) Patent No.: US 6,254,421 B1
(45) Date of Patent: Jul. 3, 2001

(54) CONNECTOR ASSEMBLY HAVING PIVOTING WIRE CARRIER WITH POSITION DETENTS

(75) Inventors: Sam Denovich, Harrisburg, PA (US); David D. Kaat, Kernersville; Randy Thomas Matthews, Yadkinville, both of NC (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/299,249

(22) Filed: Apr. 26, 1999

Related U.S. Application Data

(60) Provisional application No. 60/090,969, filed on Jun. 29, 1998.

(51) Int. Cl.[7] ..... H01R 4/24; H01R 4/26; H01R 11/20

(52) U.S. Cl. ..... 439/409; 439/417

(58) Field of Search ..... 439/409, 410, 439/417

(56) References Cited

U.S. PATENT DOCUMENTS

| | | | | |
|---|---|---|---|---|
| 4,341,430 | | 7/1982 | Crawford | 339/99 |
| 5,171,160 | * | 12/1992 | Beins et al. | 439/329 |
| 5,613,877 | * | 3/1997 | Patel et al. | 439/567 |
| 5,667,402 | * | 9/1997 | Denovich et al. | 439/409 |
| 5,681,182 | * | 10/1997 | Reichle | 439/417 |
| 5,785,548 | * | 7/1998 | Capper et al. | 439/409 |

* cited by examiner

*Primary Examiner*—Neil Abrams
*Assistant Examiner*—Hae Moon Hyeon

(57) ABSTRACT

Connector assembly (10) includes a wire carrier section 14 pivotably mounted to a housing (12) and adapted to be mounted directly to a circuit board without separate fasteners to terminate a discrete wire (180) to a contact (24) that is electrically connected to the board. A wire end (182) is inserted into a respective passageway (16,18) of the wire carrier 14, and the wire carrier section (14) is pivoted toward housing (12) pressing the wire into a slot of an IDC section (26) of the contact. The compact profile occupies minimal board real estate.

7 Claims, 5 Drawing Sheets

FIG. 7
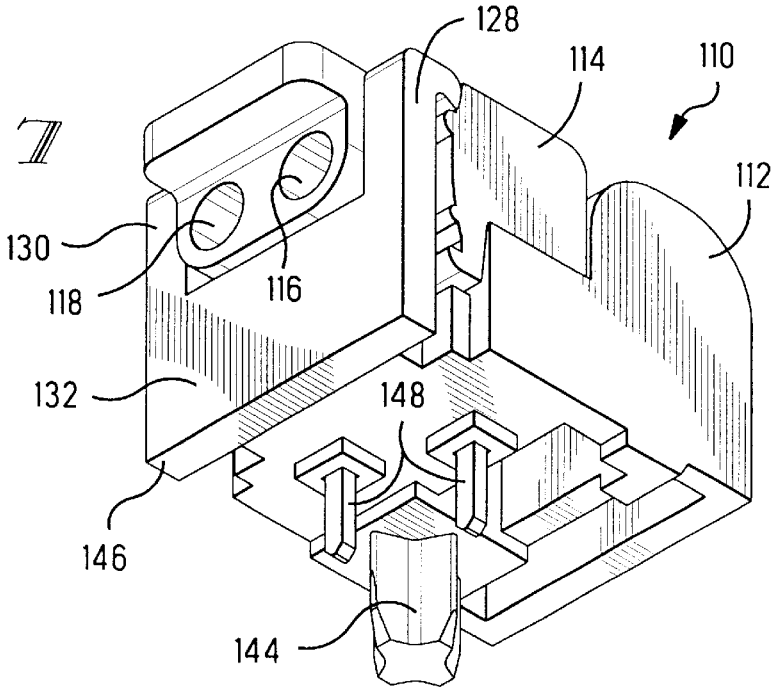
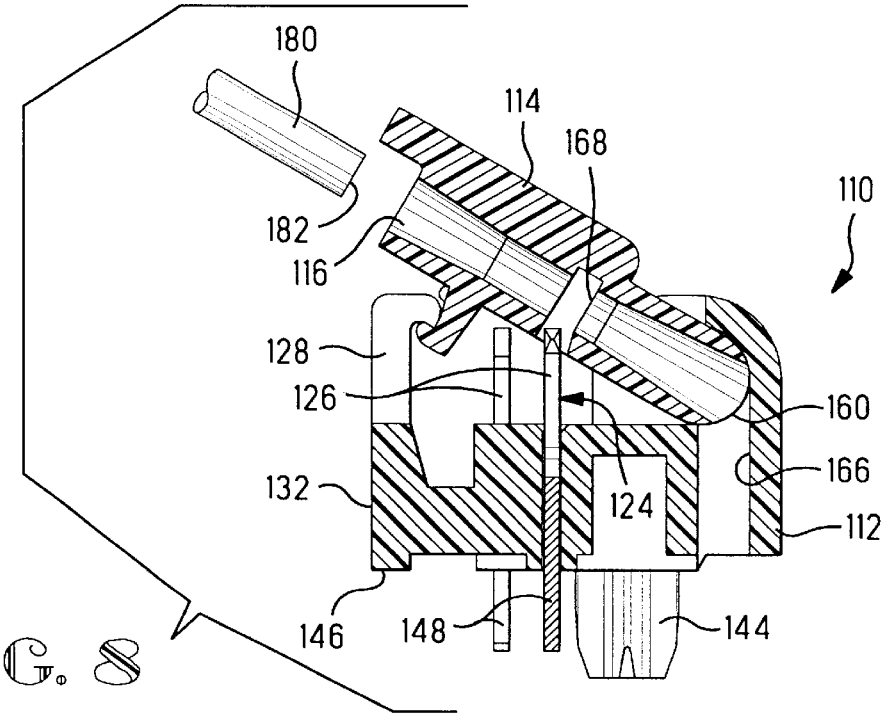
FIG. 8

CONNECTOR ASSEMBLY HAVING PIVOTING WIRE CARRIER WITH POSITION DETENTS

This application claims benefit of provisional application Ser. No. 60/090,969 filed Jun. 29, 1998.

FIELD OF THE INVENTION

This relates to the field of electrical connectors and more particularly to connectors for terminating a discrete wire conductor to a contact.

BACKGROUND OF THE INVENTION

In U.S. Pat. No. 5,667,402 is disclosed an electrical connector module that facilitates termination of one or more conductor wires to respective terminals of the module, especially for electrical connection of tip and ring wires to a network interface device module, in telephone. The module includes a pair of wire carriers at respective wire termination sections of a housing, each wire carrier having two wire-receiving passageways. Each wire carrier is affixed to the housing at a pivot section enabling pivoting of the wire carrier between wire insertion positions and wire termination positions. A contact is associated with each wire and is mounted to the housing such that it extends outwardly to be received into a slot of the wire carrier when the carrier is pivoted to the wire termination position, the slot intersecting the wire-receiving passageway. A wire is inserted into each passageway of the carrier, and the carrier is then pivoted to the termination position urging the wires into slots of insulation displacement sections of the respective contacts held by the housing.

It is desired to provide a wire carrier that is mountable to a circuit board to enable termination of at least one wire to a respective contact mounted to the circuit board.

SUMMARY OF THE INVENTION

The present invention provides a wire carrier assembly that is mountable to a circuit board and includes a housing and a wire carrier section pivotably mounted thereto. The housing includes preferably a single board-mounting section that extends into a mounting hole of the circuit board in a force fit, thus occupying minimal circuit board real estate allowing close side-by-side spacing of several such modules, if desired. A stop section limits pivoting upwardly and also secures the wire carrier to the housing in cooperation with a pair of stop members of the housing; a pair of first detents secures the wire carrier in its wire-receiving position; the first and second detents ride over the stop members of the housing when the carrier is pivoted to its wire-terminating position, and the second detents secure the carrier in the second position.

An embodiment of the invention will now be described by way of example with reference to the accompanying drawings.

BRIEF DESCRIPTION OF THE DRAWINGS

FIG. 7 is an isometric view of the assembly of FIGS. 5 and 6 from below;

FIGS. 8 and 9 are cross-sectional views of the assembly of FIGS. 5 to 7 receiving a wire and terminating the wire, respectively.

DETAILED DESCRIPTION

Figure 1:
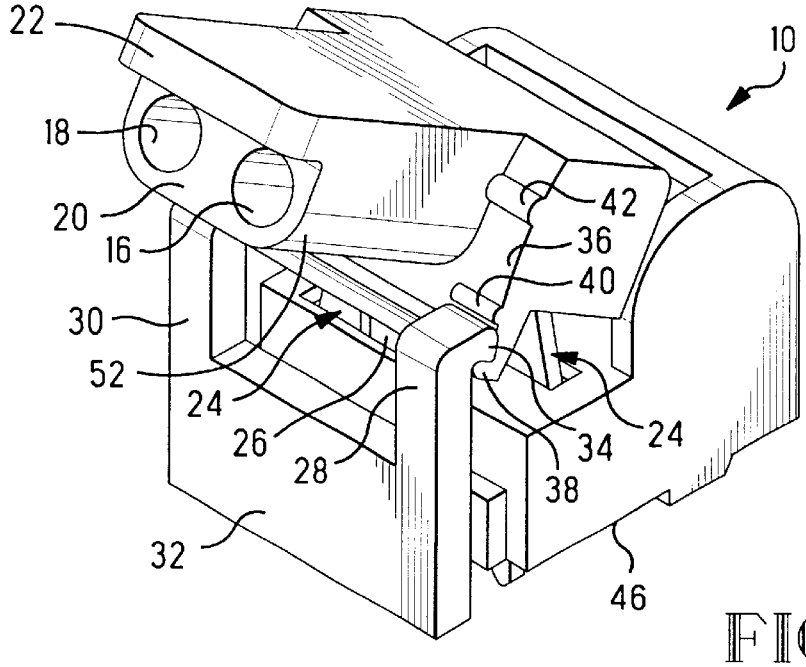
FIG. 1 is an isometric view of the assembly of the present invention.
Figure 5:
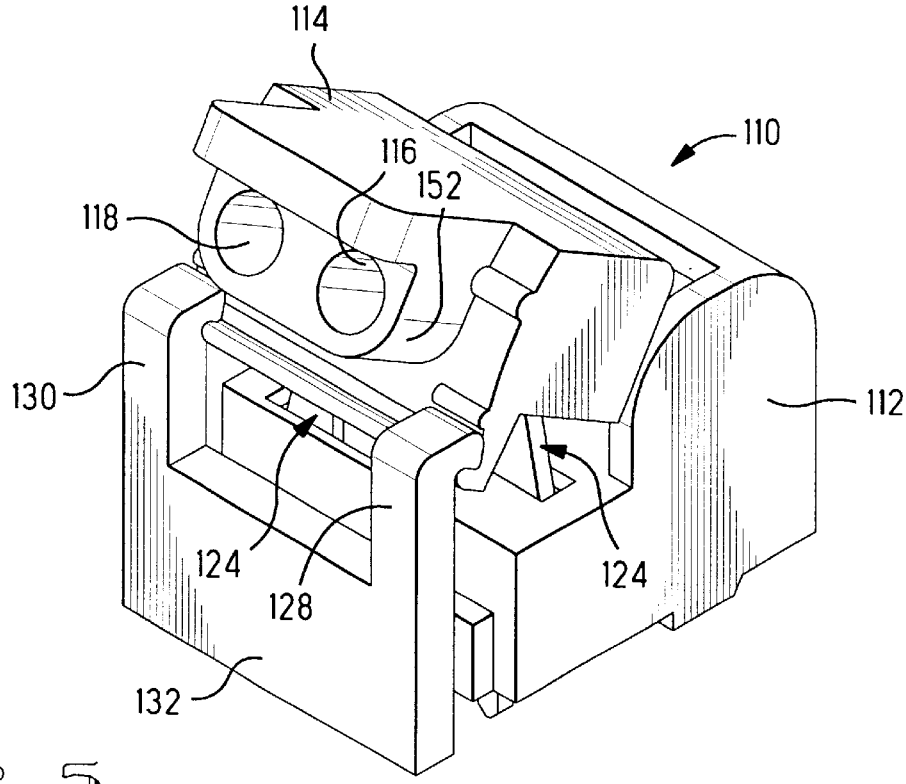
FIG. 5 is an isometric view of another embodiment of the assembly having a short wire carrier section.
Figure 2:
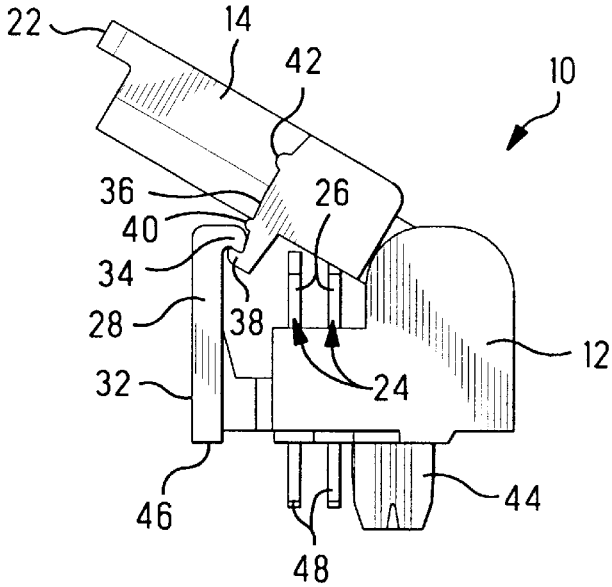
FIGS. 2 and 3 are side elevation views of the assembly of FIG. 1 illustrating the wire-receiving and wire-terminating positions of the pivotable wire carrier section, respectively.
Figure 3:
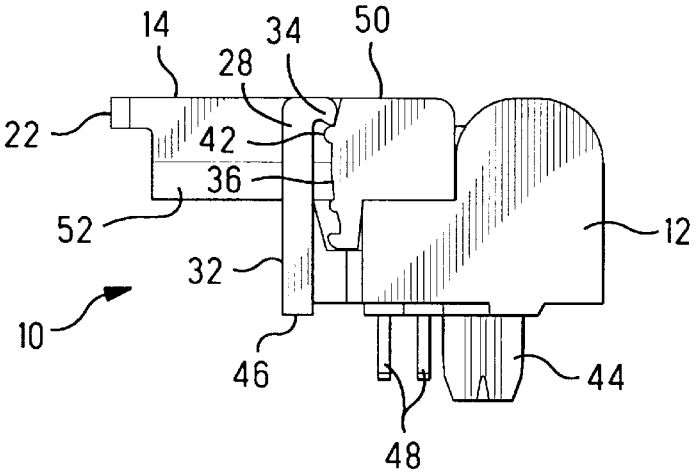
Figure 4:
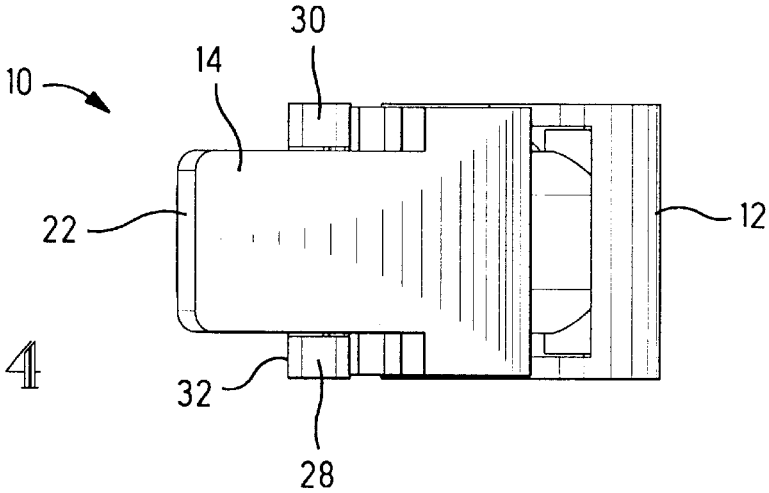
FIG. 4 is a plan view of the assembly of FIGS. 1 to 3 in the wire-receiving position.

Connector assembly 10 of FIGS. 1 to 4 includes an insulative housing 12 and a wire carrier section 14 that is pivotably mounted to housing 12. Wire carrier section 14 is shown to include a pair of wire-receiving passageways 16,18 extending rearwardly from a wire-receiving face 20, and also includes a manually engageable tab 22 to facilitate pivoting of the wire carrier section between wire-receiving position (FIGS. 1 and 2) and a wire-terminating position (FIG. 3). A pair of contacts 24 are affixed in housing 12 (see FIGS. 2 and 3) for termination to respective wires, with wire-terminating sections 26 projecting upwardly from housing 12 into corresponding slots (see FIGS. 8 and 9) of wire carrier section 14 and intersecting respective passageways 16,18. Wire-terminating sections 26 are of the insulation displacement (IDC) type, defining a wire-receiving IDC slot between a pair of upstanding beams that includes an entrance adjacent upper portions of the beams, with the passageway passing above the entrance when the wire carrier is in the open position. The beams will penetrate the wire insulation as the wire disposed in the passageway, is urged downwardly into and past the entrance to the wire-receiving slot and compressively engage the conductor of the wire for electrical connection therewith, when the wire carrier section is pivoted to the wire-terminating or second position.

Housing 12 includes preferably a pair of projections 28,30 at opposed sides of front face 32 that extend upwardly to rearwardly extending stop members 34. Wire carrier section 14 is shown to include depending wall 36 adjacent projections 28,30 concluding in a corresponding stop section 38 that will abut stop members 34 of projections 28,30 of the housing to define the uppermost pivot position of the wire carrier, that is, the wire-receiving or first position. Wire carrier section 14 further includes first and second detents 40,42 vertically aligned with stop section 38 and projections 28,30. First or open position detent 40 is closely spaced from stop section 38 and is engageable with stop member 34 of the housing projection when the wire carrier section is in its wire-receiving position, thus holding the wire carrier section in that position by resisting inadvertent pivoting, as shown in FIGS. 1 and 2. First detent 40 will ride over stop member 34 during pivoting of the wire carrier section to its second or wire-terminating position. Second or clasp position detent 42 also rides over stop member 34 and seats therebeneath when wire carrier section 14 has been fully pivoted to its second or wire-terminating position, thus securing it in that position as seen in FIG. 3.

A board-mounting projection or peg 44 is seen in FIGS. 2 and 3 to depend from board-mounting face 46 of housing 12 for securing the assembly to a circuit board (not shown) when force-fitted into a corresponding mounting hole of the board. Contacts 24 are seen to include pin sections 48 that depend from board-mounting face 46 to be electrically connected with corresponding circuits of the circuit board when inserted into plated through-holes thereof, as is conventional. FIG. 3 illustrates that top surface 50 of wire carrier section 14 is flush with the top surface of housing 12, the top ends of projections 28,30 and tab 22 when in the wire-terminating or second position. Forward section 52 projects forwardly between and beyond projections 28,30 and is shown to be substantially elongate in the embodiment of FIGS. 1 to 4 to protrude beyond front face 32 of the housing.

In the embodiment of connector assembly 110 shown in FIGS. 5 to 10, forward section 152 of wire carrier section 114 is foreshortened and protrudes only slightly between projections 128,130 and beyond front face 132 of housing 112 to minimize the overall length of the connector when compactness is necessary. Otherwise, assembly 110 is identical to assembly 10 of FIGS. 1 to 4.

Figure 6:
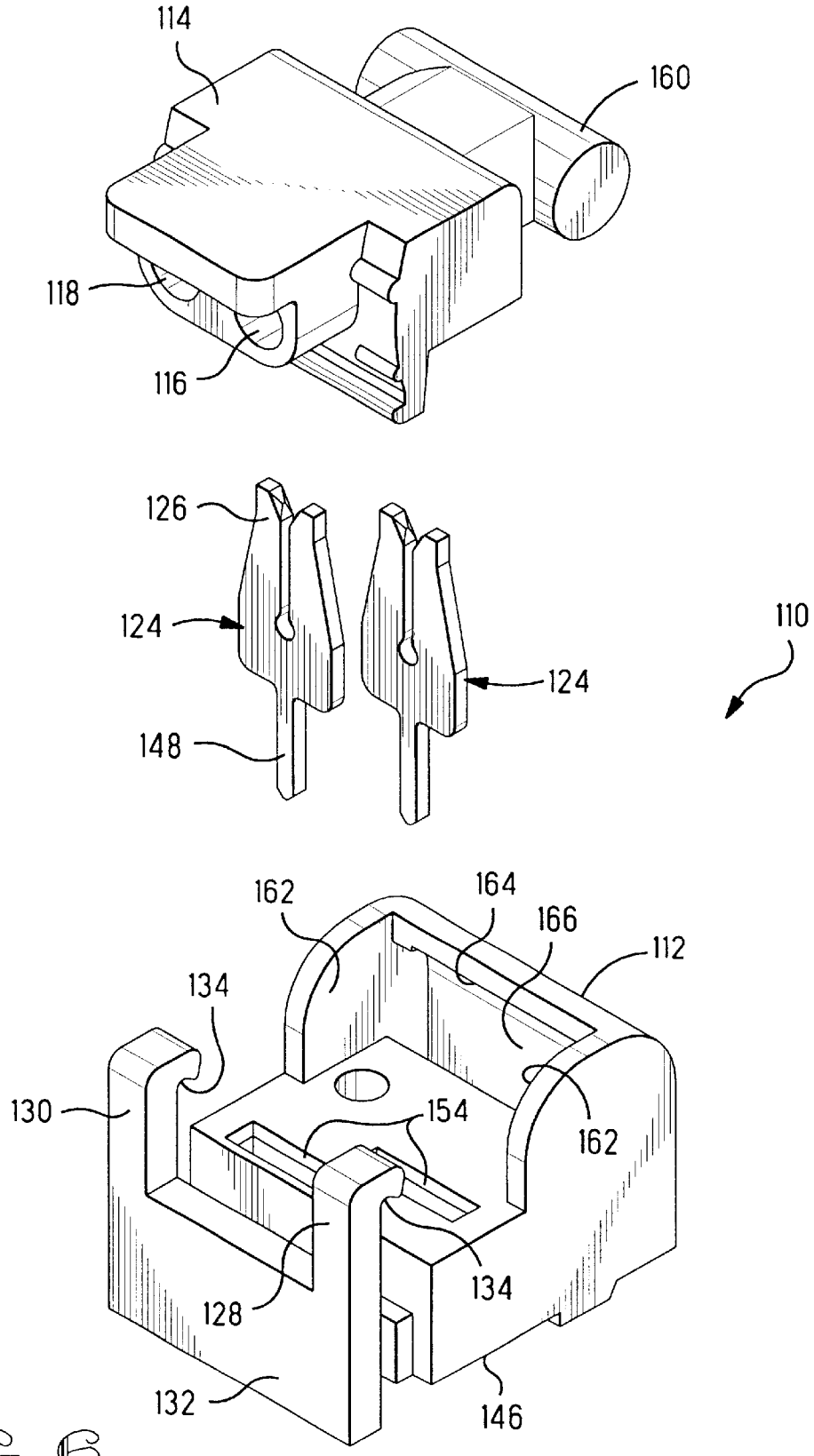
FIG. 6 is an isometric view of the assembly of FIG. 5 with the wire carrier section and a pair of contacts exploded from the housing.

FIG. 6 shows wire carrier section 114 exploded above housing 112, with contacts 124 also exploded above the housing. Contact-receiving slots 154 are adapted to receive contacts 124 thereinto in a force fit during assembly, with board-connecting pin sections 148 to pass through the bottoms of the slots to project beyond board-mounting face 146 of the housing (FIGS. 7 to 10). Wire carrier section 114 includes a pivot bar 160 along its rearward end that is seatable between side walls 162 of housing 112 and under ledge 164 that defines the housing's cooperating pivot section, with the carrier section being assembled to the housing by urging stop member 138 beneath stop members 134 of projections 128,130. In FIG. 7 is seen the board-mounting face of connector 110, with board-mounting peg 144 shown to include several, preferably four, deformable ribs that establish a force fit with the board-mounting hole having a diameter slightly less than the major dimension of peg 144, as is known.

Figure 9:
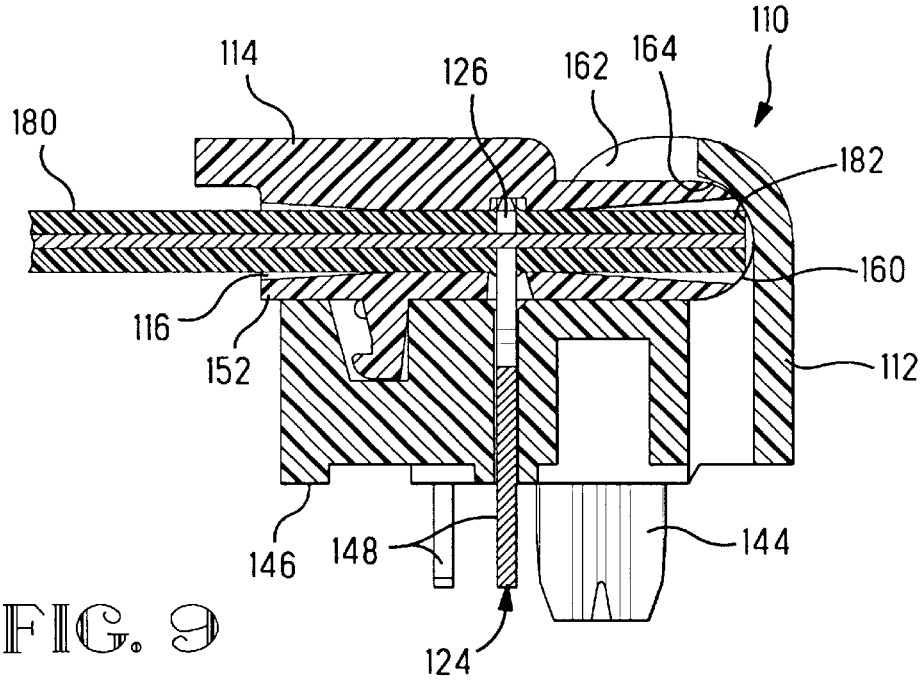

FIGS. 8 and 9 illustrate the termination of a representative wire 180 to connector assembly 110. Wire end 182 is first inserted into passageway 116 until abutted against rear wall 166 of housing 112, thus intersecting IDC-receiving slot 168 midway along the passageway and being assuredly positioned above IDC section 126 of contact 124. Then wire carrier section 114 is pivoted to the second or wire-terminating position as seen in FIG. 9, with the top of the passageway pressing wire 180 into the IDC section for assured mechanical and electrical connection with contact 124.

Figure 10:
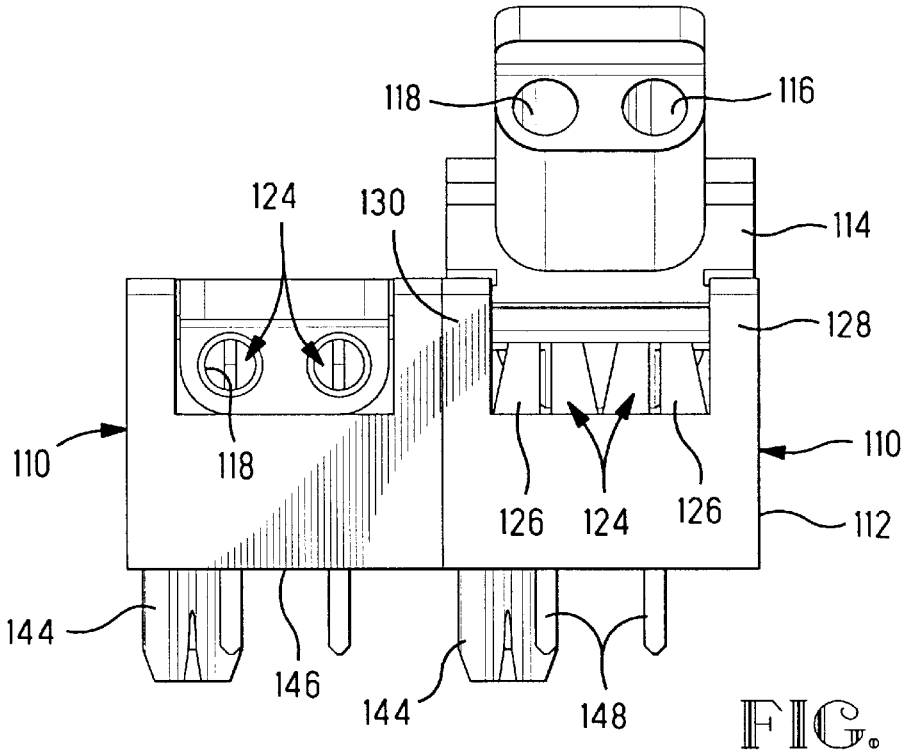
FIG. 10 is a front view illustrating the side-by-side placement of two assemblies in abutting relationship.

FIG. 10 is illustrative of the compact design of connector assembly 110. Using only a single board-mounting peg 144, minimal real estate of the circuit board is thus used, allowing several connector assemblies 110,110 to be positioned adjacent each other, side-by-side in a row.

Modifications and variations may occur to the specific embodiment disclosed herein, that are within the spirit of the invention and the scope of the claims.

What is claimed is:

1. A connector assembly for termination to an insulated wire, comprising:

an insulative housing;

at least one wire carrier pivotably mounted to said housing at a termination location;

a terminal mounted in said housing and including an IDC section defined by a pair of beam portions having an IDC slot therebetween extending upwardly to an entrance to said IDC slot at upper portions of said beam portions;

said wire carrier having a pivot section at a rear end thereof disposed within a complementary pivot section of said housing, and further having a wire-receiving passageway thereinto from a front face that passes above said entrance to said IDC slot of said terminal when said wire carrier is in a first or open position, and said wire carrier being pivotable to a second or closed position, thereby urging a wire disposed along said wire-receiving passageway into said IDC slot;

wherein said wire carrier includes a stop section that cooperates with a pair of stop members of said housing to limit upward pivoting movement to define said first or open position of said wire carrier; and wherein said wire carrier includes a pair of closed position detents cooperable with respective said stop members of said housing to secure said wire carrier in said closed position, said closed position detents adapted to ride over said stop members when said wire carrier is pivoted to said closed position.

2. The connector assembly as set forth in claim 1 wherein said wire carrier includes a manually engageable tab protruding forwardly of said front face and thereabove, facilitating manual engagement for pivoting said wire carrier between said open and closed positions.

3. The connector assembly as set forth in claim 1 wherein said board-mounting projection includes a plurality of deformable ribs that establish a force fit with said board-mounting hole having a diameter slightly less than said board-mounting projection.

4. The connector assembly as set forth in claim 1 wherein said stop members of said housing are defined on upstanding legs positioned laterally from opposed sides of said wire carrier and rearwardly from said front face thereof.

5. The connector assembly as set forth in claim 1 wherein said wire carrier includes a pair of open position detents cooperable with respective said stop members of said housing to secure said wire carrier in said open position, said open position detents adapted to ride over said stop members when said wire carrier is pivoted to said open position.

6. The connector assembly as set forth in claim 1 wherein said housing defines a board-mounting face, and said terminal includes a contact section exposed along said board-mounting face of said housing for establishing an electrical connection to a circuit board upon mounting said housing thereto.

7. The connector assembly as set forth in claim 1 wherein said housing defines a board-mounting face, and said housing includes a board-mounting projection depending from said board-mounting face to enter a mounting hole of said circuit board in a force-fit.

* * * * *